US007506397B2

(12) United States Patent
Tanaka

(10) Patent No.: US 7,506,397 B2
(45) Date of Patent: Mar. 24, 2009

(54) CLEANING SHEET

(75) Inventor: Yoshinori Tanaka, Kagawa (JP)

(73) Assignee: Uni-Charm Corporation, Ehime (JP)

( * ) Notice: Subject to any disclaimer, the term of this patent is extended or adjusted under 35 U.S.C. 154(b) by 765 days.

(21) Appl. No.: 11/124,360

(22) Filed: May 9, 2005

(65) Prior Publication Data

US 2005/0268418 A1 Dec. 8, 2005

(30) Foreign Application Priority Data

Jun. 3, 2004 (JP) ..... 2004-166296

(51) Int. Cl.
*A47L 13/16* (2006.01)

(52) U.S. Cl. ..... 15/228; 15/208; 15/209.1

(58) Field of Classification Search ..... 15/209.1, 15/231, 208, 228
See application file for complete search history.

(56) References Cited

U.S. PATENT DOCUMENTS 6,045,622 A 4/2000 Holt et al.
6,810,554 B2 * 11/2004 McKay ..... 15/228
7,007,338 B2 * 3/2006 Garabedian et al. ..... 15/231
7,028,364 B2 * 4/2006 Policicchio et al. ..... 15/228
2003/0045197 A1 3/2003 Kakiuchi et al.

FOREIGN PATENT DOCUMENTS

JP 98/11812 3/1998
JP 98/23199 6/1998
JP 98/42246 10/1998
JP 3094858 4/2003

OTHER PUBLICATIONS

European Search Report dated May 10, 2007, directed counterpart EP application No. 05252791.

* cited by examiner

*Primary Examiner*—Randall Chin
(74) *Attorney, Agent, or Firm*—Morrison & Foerster LLP

(57) ABSTRACT

Disclosed is a cleaning sheet to be attached to a cleaning head. The cleaning sheet has an attachment sheet dimensioned to cover a nozzle head provided in the cleaning head. Liquid squirted from the nozzle head can be received by the attachment sheet and come between the cleaning head and the cleaning sheet. Since the cleaning sheet has a liquid permeable attachment surface, the liquid having reached the attachment surface can be absorbed by a liquid absorbent sheet of the cleaning sheet and gradually applied to a floor surface to be cleaned.

5 Claims, 6 Drawing Sheets

CLEANING SHEET

BACKGROUND OF THE INVENTION

1. Field of the Invention

The present invention relates to a cleaning sheet which is intended to be used for cleaning as attached to a mop-like cleaning device or the like, and more particularly to a cleaning sheet which can absorb and retain liquid.

2. Description of the Related Art

There have been known cleaning sheets which should be used for cleaning the house floor as attached to a cleaning head of a mop-like cleaning device. Such conventional cleaning sheets are typically constructed of a single nonwoven fabric or by layering two or more nonwoven fabrics on top of one another and used in a dry state. When they are used in a dry state, dirt or dust can be trapped between fibers on the surface of the nonwoven fabric. Alternatively, an adsorbent lubricant is coated thereon to let dirt or dust adhere to the sheet surface.

However, such cleaning sheets to be used in a dry state are not effective in removing stains adhered to the floor surface, although they are effective in collecting fluffy dust.

Japanese Utility-Model Registration No. 3094858 discloses a cleaning device which has nozzles in a cleaning head for squirting water to the floor surface. After wetted with water, the floor surface is wiped off with a cleaning sheet attached to the cleaning head. Japanese Unexamined Patent Publication No. 2001-521432 also discloses a cleaning device with a liquid supply part on a handle which extends upward from the top face of a cleaning head.

The cleaning devices disclosed in the above-identified documents are used such that the nozzles provided in the cleaning head apply water or cleaning liquid to the outside of the cleaning head, and the floor surface wetted with the water or cleaning liquid is then wiped off with a cleaning pad. The cleaning pad, which is designed to be attached to the bottom face of the cleaning head, has a liquid permeable sheet on a cleaning surface side to be applied to the floor surface, or the like, and a liquid absorbent layer behind the liquid permeable sheet. It should be noted that the back side of the cleaning pad, which faces the cleaning head, is typically covered with a liquid impermeable sheet.

However, in the case where the cleaning head is provided with the nozzles, as in Japanese Utility-Model Registration No. 3094858, if the water or cleaning liquid flows down the cleaning head after being squirted out of the nozzles, it tends to spread between the cleaning head and the cleaning pad. Because the back side of the cleaning pad is impermeable to liquid, the water or cleaning liquid tends to remain between the cleaning head and the cleaning pad. When the cleaning pad is removed from the cleaning head, the water or cleaning liquid drips on the floor surface, and the cleaning head after removal of the cleaning pad remains soaked with the cleaning liquid.

Moreover, if the cleaning liquid remains between the cleaning head and the cleaning pad, the coefficient of friction between the cleaning head and the cleaning pad may be decreased and cause slippage between the back side of the cleaning pad and the cleaning head when the cleaning pad is slid on the floor surface.

In Japanese Utility-Model Registration No. 3094858, furthermore, the liquid is directly applied to the floor surface from the nozzles of the cleaning head. If the floor surface to be cleaned is a ceramic tile floor, a large amount of liquid may be directly applied to the floor surface without any problem, but if the floor surface is a wooden floor on which a finishing compound such as a paint is applied, a large amount of cleaning liquid may deteriorate the finishing compound.

SUMMARY OF THE INVENTION

The present invention has been developed to solve the problems in the prior art set forth above and has an object to provide a cleaning sheet which prevents a bottom face of a cleaning head from becoming soaked with liquid.

Another object of the present invention is to provide a cleaning sheet which permits application of a moderate amount of liquid to a surface to be cleaned.

According to the invention, there is provided a cleaning sheet having an attachment surface side to be applied to a cleaning head of a cleaning device and a cleaning surface side to be applied to an object to be cleaned, the cleaning sheet comprising a liquid permeable exterior sheet on the cleaning surface side and a liquid absorbent sheet behind the exterior sheet, wherein the liquid absorbent sheet is permitted to absorb liquid applied to the attachment surface side.

According to the present invention, liquid coming between the cleaning head and the cleaning sheet can be absorbed by the liquid absorbent sheet of the cleaning sheet. This prevents the liquid from remaining between the cleaning head and the cleaning sheet.

According to one embodiment of the present invention, a liquid permeable backing sheet may be provided on the attachment surface side to cover the liquid absorbent sheet. Alternatively, the liquid absorbent sheet may be exposed on the attachment surface side of the cleaning sheet without providing the backing sheet.

Preferably, first and second attachment sheets are provided to extend in opposite directions from longer sides of a rectangular main body in which the liquid absorbent sheet is present, the first attachment sheet being dimensioned to cover a liquid jetting part provided in the cleaning head. In this construction, liquid discharged from the liquid jetting part may flow down the first attachment sheet and be directed to and absorbed by the liquid absorbent sheet. The liquid thus applied to the liquid absorbent sheet can ooze out through the exterior sheet for cleaning the floor surface or the like.

Moreover, the second attachment sheet may have an indentation through which the liquid jetting part is able to squirt liquid out of the cleaning head. In this construction, the liquid may be squirted out of the cleaning head and applied to the floor surface by exposing the liquid jetting part through the indentation or may flow down the first attachment sheet to reach the liquid absorbent sheet by covering the liquid jetting part as set forth above.

Also preferably, the first attachment sheet dimensioned to cover the liquid jetting part has a water repellent interior surface for facing the liquid jetting part. If so, the liquid discharged from the liquid jetting part can flow down the first attachment sheet to quickly arrive at the main body of the cleaning sheet. This also prevents the liquid from remaining on the interior surface of the first attachment sheet.

According to the present invention, as has been described above, the liquid coming between the cleaning head and the attachment surface side of the cleaning sheet can be absorbed by the liquid absorbent sheet to prevent the liquid from remaining beneath the bottom face of the cleaning head. The liquid thus absorbed in the liquid absorbent sheet may be used for wiping the floor surface or the like.

BRIEF DESCRIPTION OF THE DRAWINGS

The present invention will be understood more fully from the detailed description given hereinafter and from the accompanying drawings of the preferred embodiment of the present invention, which, however, should not be taken to limit the invention, but are for explanation and understanding only.

In the drawings.

DESCRIPTION OF THE PREFERRED EMBODIMENT

The present invention will be discussed hereinafter in detail in terms of the preferred embodiments of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscuring of the present invention.

Figure 1:
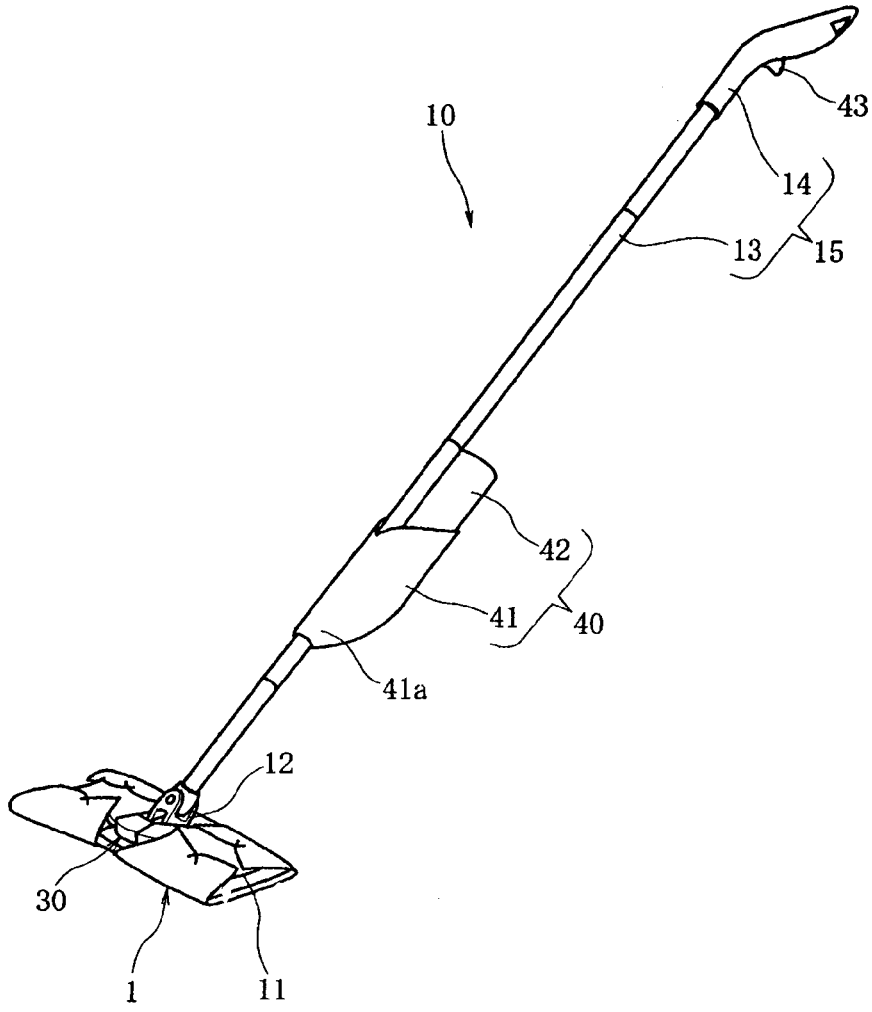
FIG. 1 is a perspective view of a cleaning device to which a cleaning sheet according to one embodiment of the present invention may be attached.
Figure 2:
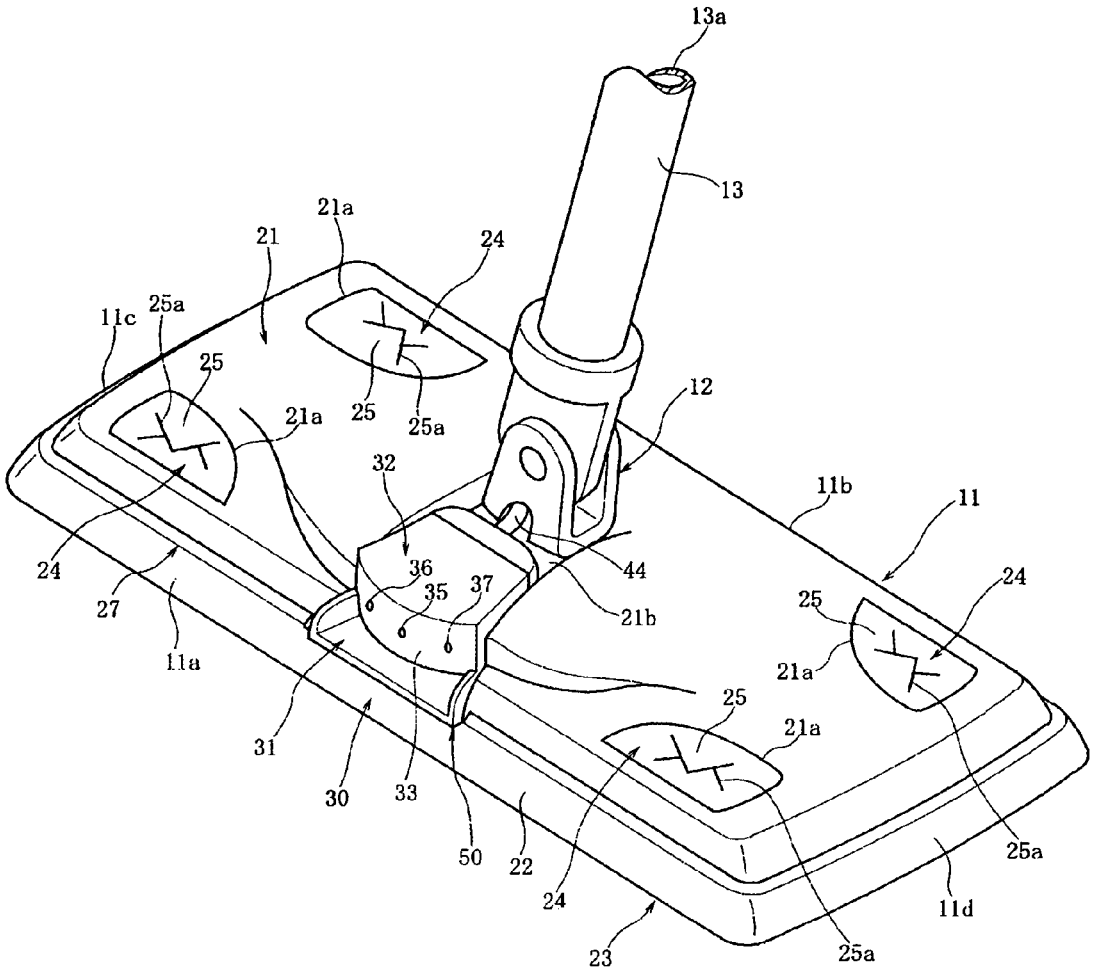
FIG. 2 is an enlarged perspective view showing a cleaning head of a cleaning device.
Figure 3:
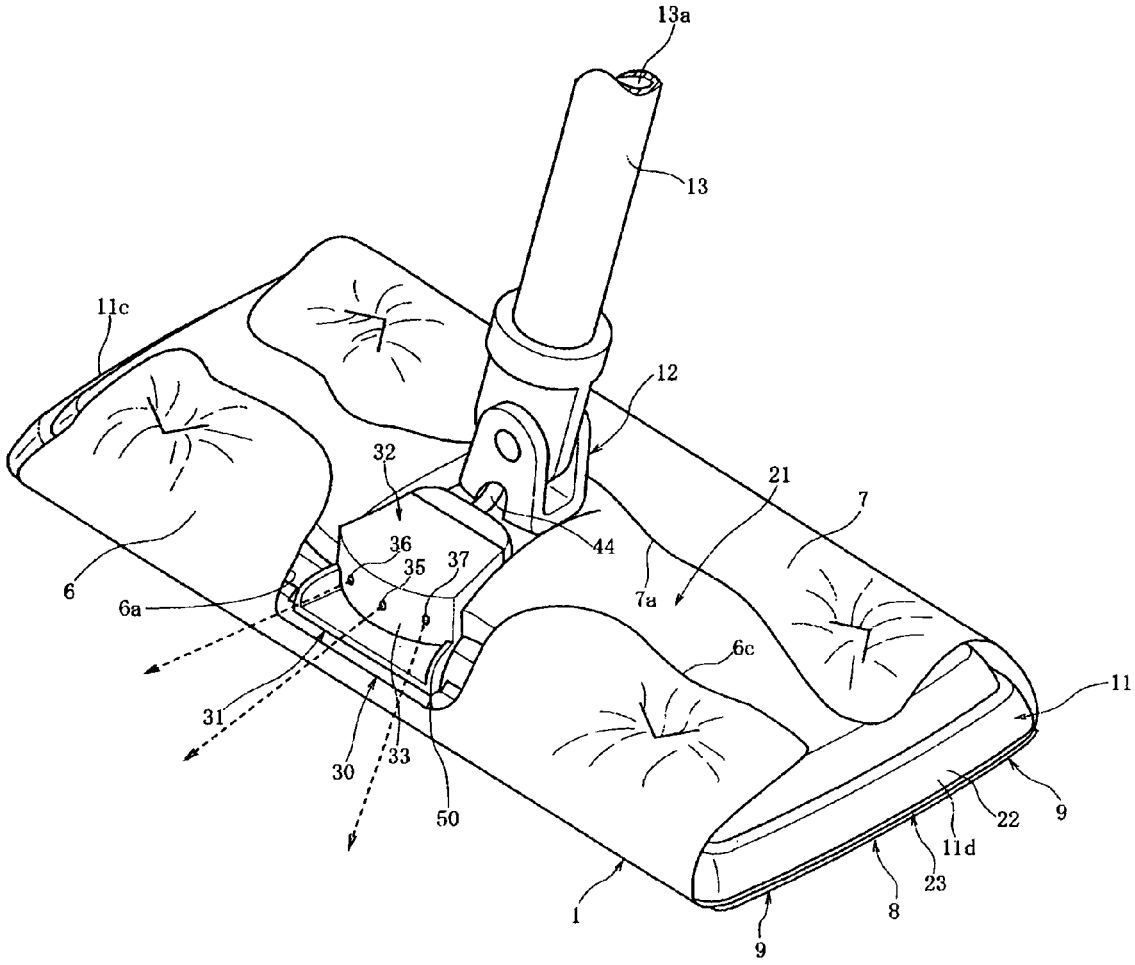
FIG. 3 shows a first usage of a cleaning sheet according to an embodiment of the invention.
Figure 4:
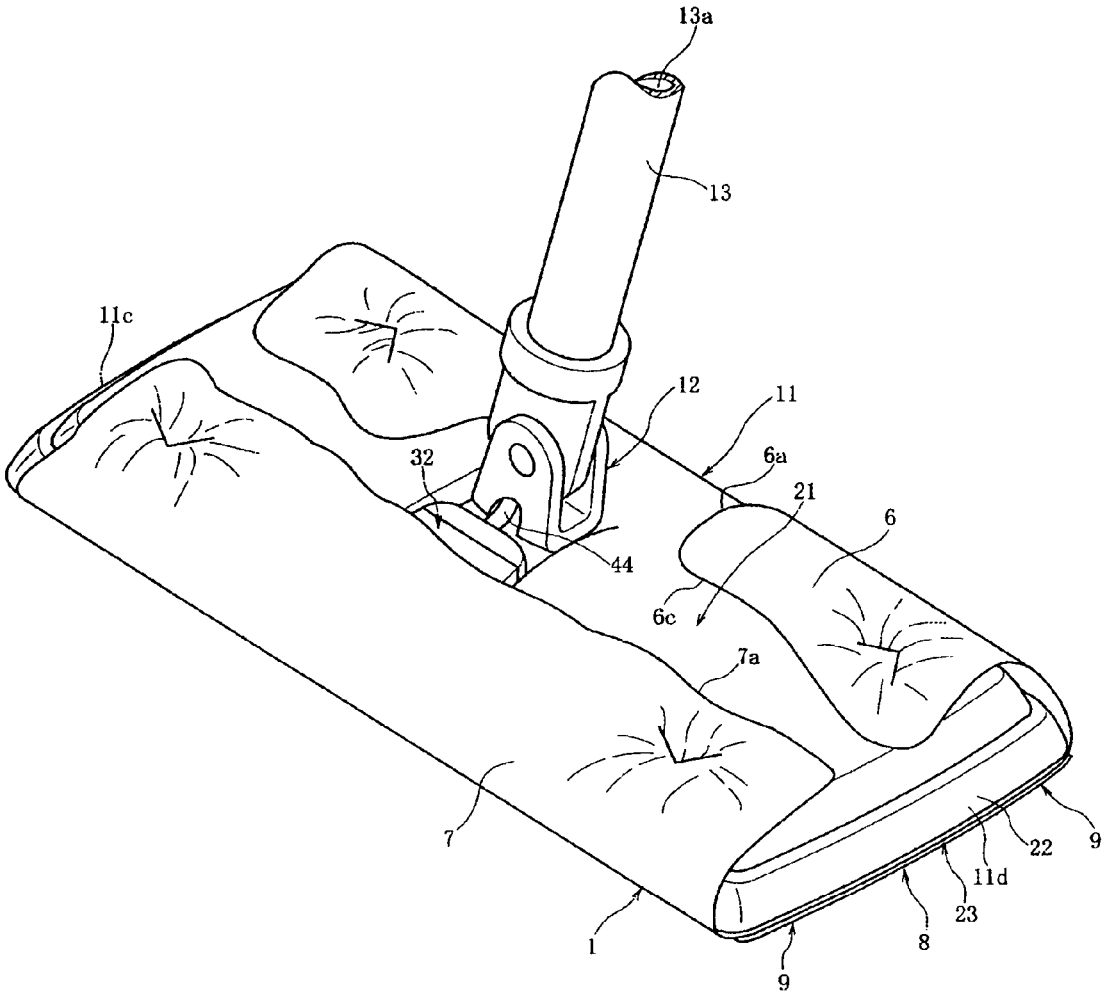
FIG. 4 shows a second usage of a cleaning sheet according to another embodiment of the invention.
Figure 5:
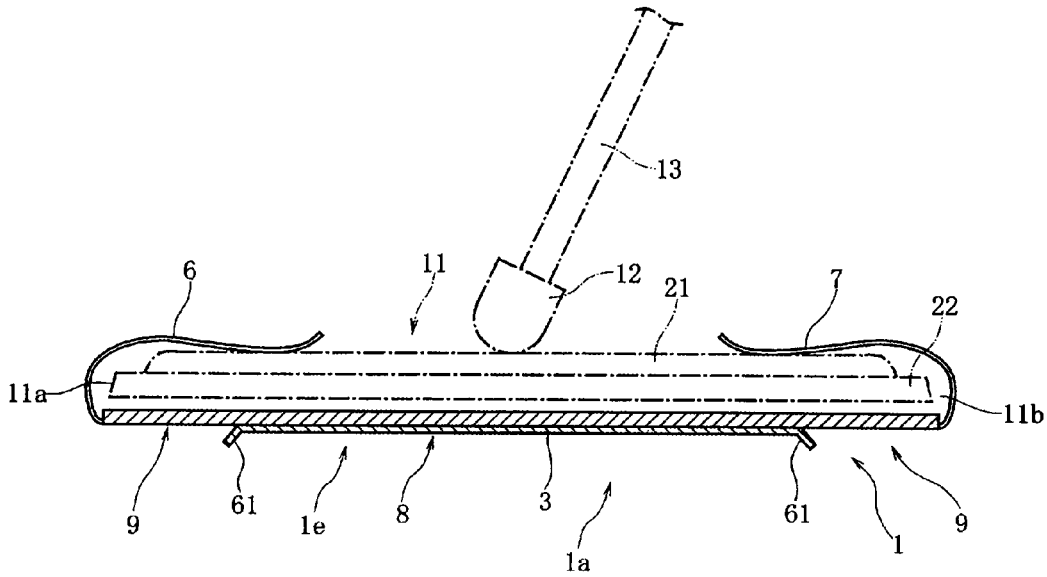
FIG. 5 is a side view showing a state where a cleaning sheet is attached to a cleaning head according to an embodiment of the invention.
Figure 6:
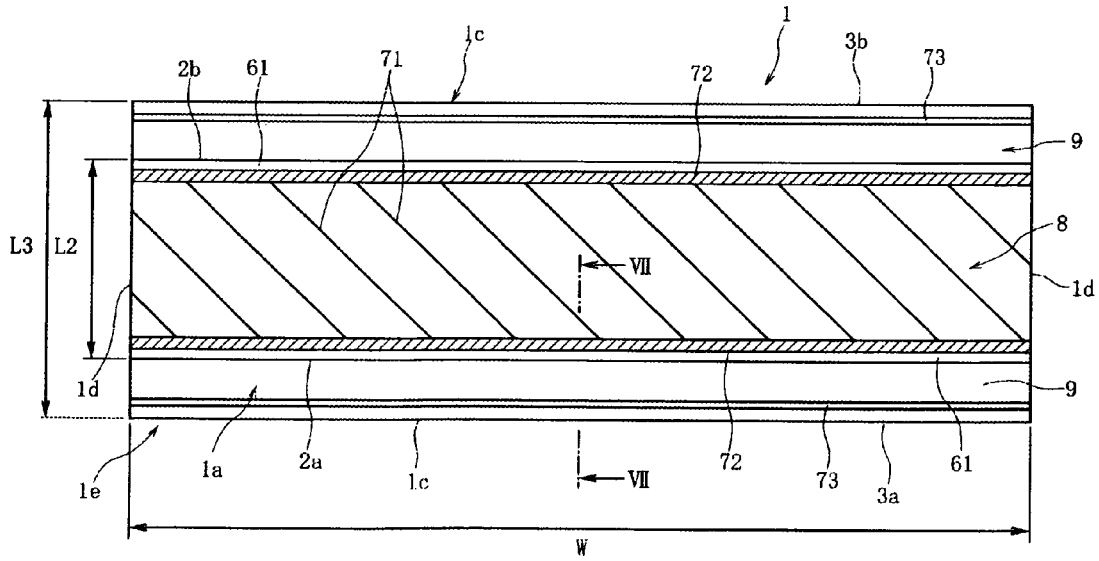
FIG. 6 is a bottom view showing a cleaning surface side of a cleaning sheet according to an embodiment of the invention.
Figure 7:
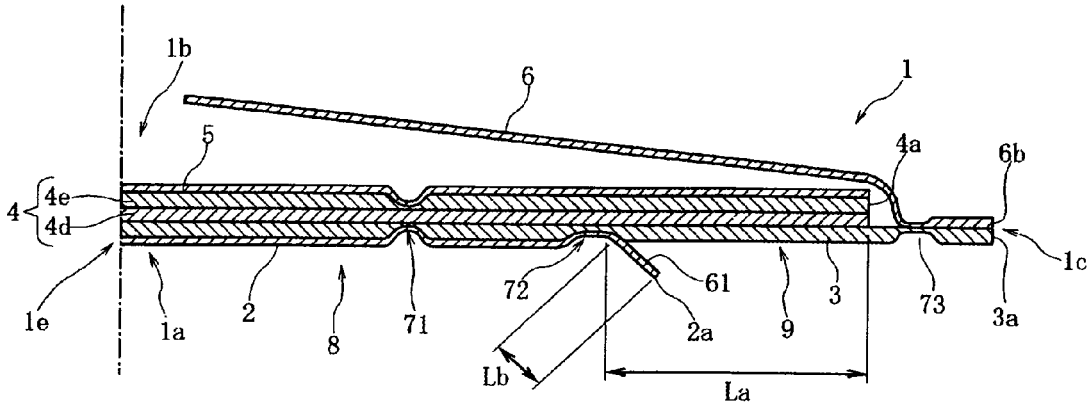
FIG. 7 is a sectional view taken along line VII-VII of FIG. 6.
Figure 8:
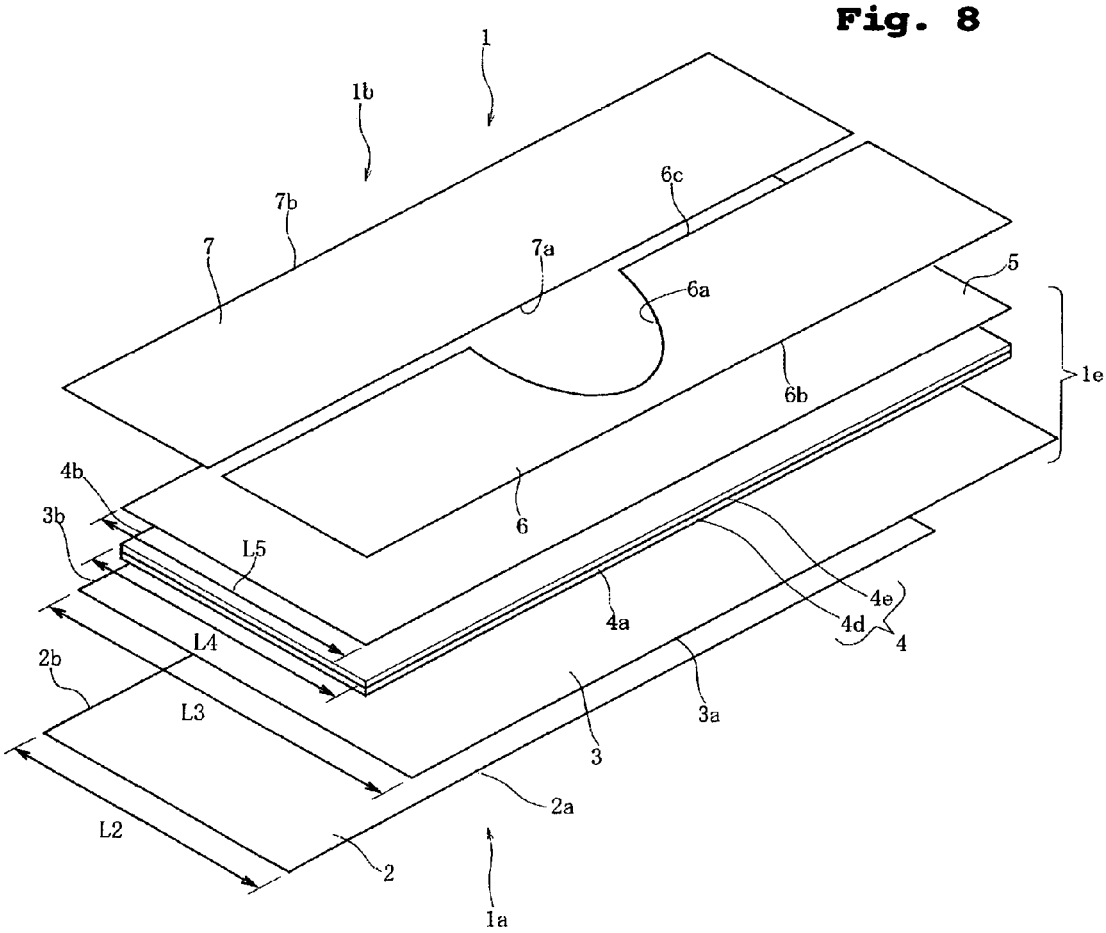
FIG. 8 is an exploded perspective view of a cleaning sheet according to an embodiment of the invention.

FIG. 1 is a perspective view of a cleaning device 10 to which a cleaning sheet 1 according to one embodiment of the present invention is suitably attached; FIG. 2 is an enlarged perspective view showing a cleaning head 11 of the cleaning device 10; FIGS. 3 and 4 are perspective views showing states where the cleaning sheet 1 is attached to the cleaning head 11 in different orientations; FIG. 5 is a side view showing a state where the cleaning sheet 1 is attached to the cleaning head 11; FIG. 6 is a bottom view showing a cleaning surface side of the cleaning sheet 1; FIG. 7 is a sectional view taken along line VII-VII of FIG. 6; and FIG. 8 is an exploded perspective view of the cleaning sheet 1.

The cleaning sheet 1 according to one embodiment of the present invention is suitably used as attached to the cleaning head 11 of the cleaning device 10. The cleaning sheet 1 has an attachment surface 1*b* to be applied to a bottom face 23 of the cleaning head 11 and a cleaning surface 1*a* to be applied to a floor surface or the like. As shown in FIGS. 7 and 8, the cleaning sheet 1 preferably has a main body 1*e* which is constructed by stacking a first exterior sheet 2, a second exterior sheet 3, a liquid absorbent sheet 4 and a backing sheet 5 in the order mentioned above from the cleaning surface 1*a* to the attachment surface 1*b*.

As shown in FIG. 6, the main body 1*e* is of a rectangular shape having parallel longer sides 1*c*, 1*c* and parallel shorter sides 1*d*, 1*d*. When the cleaning sheet 1 is used for cleaning the floor surface or the like, one of the longer sides 1*c*, 1*c* is to be situated forward in a wiping direction. First and second attachment sheets 6, 7 are joined to the main body 1*e* along the longer sides 1*c*, 1*c*, respectively.

The individual sheets have an equal width W in a direction from side to side (hereinafter called the "transverse direction"). In a direction from front to rear (hereinafter called the "longitudinal direction"), on the other hand, the first exterior sheet 2 has a length L2, the second exterior sheet 3 has a length L3, the liquid absorbent sheet 4 has a length L4 and the backing sheet 5 has a length L5. As shown in FIG. 6, the length L3 of the second exterior sheet 3 is equal to the length of the shorter side 1*d* of the main body 1*e*.

The length L4 of the liquid absorbent sheet 4 is preferably equal to the length L5 of the backing sheet 5, and the length L4/L5 is preferably shorter than the length L3 of the second exterior sheet 3. As shown in FIG. 7, therefore, one longer side 3*a* of the second exterior sheet 3 is at a distance from one longer side 4*a* of the liquid absorbent sheet 4. Likewise, the other longer side 3*b* of the second exterior sheet 3 is at a distance from the other longer side 4*b* of the liquid absorbent sheet 4.

The length L2 of the first exterior sheet 2 is preferably shorter than the length L3 of the second exterior sheet 3 and the length L4 of the liquid absorbent sheet 4. In a side region 9 which extends along the longer side 1*c* with a length La, the cleaning surface side of the cleaning sheet 1 is not covered with the first exterior sheet 2 and the second exterior sheet 3 covering the liquid absorbent sheet 4 is exposed externally, as shown in FIG. 7. In a central region 8, on the other hand, the cleaning surface side is covered with the first exterior sheet 2.

The dimensions of the main body 1*e* (or the cleaning surface 1*a*) are not particularly limited as long as the cleaning sheet 1 can be suitably used for wiping a floor surface or the like, but for instance, the length L3 may be about 60 to 160 mm, the width W may be about 200 to 320 mm. The length La of the side region 9 is preferably 5 mm or more, more preferably 10 mm or more.

The first exterior sheet 2 and the second exterior sheet 3 both preferably contain heat-fusible synthetic resin fibers. In the central region 8, as shown in FIGS. 6 and 7, the first exterior sheet 2, the second exterior sheet 3 and the liquid absorbent sheet 4 may be joined together to have a plurality of parallel join lines 71 by heating under pressure, such as by heat embossing or ultrasonic embossing. The backing sheet 5 is bonded to the surface of the liquid absorbent layer 4 through a hot-melt type adhesive applied in such an amount as not to interfere with liquid transfer. Alternatively, the backing sheet 5 may be thermally bonded to the liquid absorbent layer 4 at the join lines 71.

The first exterior sheet 2 and the second exterior sheet 3 are also fixed to each other at join lines 72. The join lines 72 may be formed by heating under pressure, such as by embossing the first exterior sheet 2 and the second exterior sheet 3. The join lines 72 are spaced inward from the longer sides 2*a*, 2*b* of the first exterior sheet 2 and extend parallel to the longer sides 2*a*, 2*b*.

Along the longer side 2*a*, as shown in FIG. 7, the first exterior sheet 2 provides a flap 61 which is allowed to move freely while being fixed on the cleaning surface 1*a* at the join line 72. Along the longer side 2*b*, likewise, the first exterior sheet 2 provides another flap 61. When the cleaning sheet 1 is slid on the floor surface with the longer sides 1*c*, 1*c* directed forward and rearward in the sliding direction, the flaps 61, 61 function to remove dirt adhering to the floor surface. The flap 61 has a free length Lb which is preferably 0.5 mm or more, more preferably 1 mm or more. If the free length Lb is excessively long, the frictional resistance between the cleaning surface 1*a* and the floor surface may be increased. Therefore, the free length Lb is preferably 10 mm or less, more preferably 5 mm or less.

At the transverse center, the attachment sheet 6 has an indentation 6*a* on one edge 6*c*. On the other hand, the attachment sheet 7 is rectangular without any indentation on its edge 7*a*.

As shown in FIG. 7, the longer side 6*b* of the attachment sheet 6 is aligned with the longer side 3*a* of the second exterior sheet 3, and the second exterior sheet 3 and the attachment sheet 6, which are in face-to-face contact, are preferably bonded together through a hot-melt type adhesive to provide a join line 73 outside the longer side 4*a* of the liquid absorbent sheet 4. The join line 73 is parallel to the longer side 3*a* of the second exterior sheet 3 and extends the entire length of the cleaning sheet 1 in the transverse direction. Likewise, the longer side 7*b* of the attachment sheet 7 is aligned with the longer side 3*b* of the second exterior sheet 3, and the second exterior sheet 3 and the attachment sheet 7 are bonded together to provide another join line 73 outside the longer side 4*b* of the liquid absorbent sheet 4.

The first exterior sheet 2 is preferably a nonwoven fabric having a high fiber density, wherein at least 70 wt. % of constituent fibers are synthetic resin fibers treated to be hydrophilic or hydrophilic natural fibers, so that the first exterior sheet 2 is capable of being wetted by liquid and allows liquid applied to the sheet surface to pass through it toward the liquid absorbent sheet 4. For example, the first exterior sheet 2 may be a spunbonded nonwoven fabric of synthetic resin fibers treated to be hydrophilic or a spunlaced or point-bonded nonwoven fabric of synthetic resin fibers treated to be hydrophilic by a surfactant and/or hydrophilic natural fibers such as cotton, rayon and pulp.

The second exterior sheet 3 is preferably a low-density nonwoven fabric containing at least 70 wt. % of hydrophobic fibers. For example, the second exterior sheet 3 may be a through-air bonded nonwoven fabric in which polyethylene (PE) resin fibers, polypropylene (PP) resin fibers, polyethylene terephthalate (PET) resin fibers, PE/PP bicomponent synthetic resin fibers, or PE/PET bicomponent synthetic resin fibers are thermally bonded together by hot air. The second exterior sheet 3 preferably has a basis weight of 10 to 50 g/m$^2$ and a lower fiber density than the first exterior sheet 2.

The liquid absorbent sheet 4 may be a layered structure of a first absorbent sheet 4*d* and a second absorbent sheet 4*e*. Preferably, the first absorbent sheet 4*d* and the second absorbent sheet 4*e* are both an air-laid pulp which is manufactured by depositing pulp by air-laid process and then bonding the fibers through a resin binder. The liquid absorbent layer 4 preferably has a basis weight of about 50 to 200 g/m$^2$. The liquid absorbent layer 4 may further contain superabsorbent polymer (SAP).

However, the liquid absorbent layer 4 may be formed of other materials as long as it is capable of absorbing and retaining liquid. For example, there may be used a structure of deposited pulp, a spunlaced nonwoven fabric including rayon and pulp, a layered structure of the spunlaced nonwoven fabric, or an air-laid nonwoven fabric which is manufactured by depositing pulp and synthetic resin fibers treated to be hydrophilic by air-laid process and then bonding the fibers through a binder.

The backing sheet 5 is permeable to liquid and may be formed of the same through-air bonded nonwoven fabric as used for the second exterior sheet or a spunlaced nonwoven fabric including rayon and pulp. In an alternative, there may be used a spunbonded or point-bonded nonwoven fabric of synthetic resin fibers treated to be hydrophilic. In another alternative, a resin film (e.g., PE film) formed with a large number of liquid passage apertures may be used. Preferably, a spunbonded nonwoven fabric is used, formed of synthetic resin fibers treated to be hydrophilic and having a basis weight of 20 g/m$^2$.

The attachment sheets 6, 7 may be a point-bonded or spunbonded nonwoven fabric of synthetic resin fibers. The attachment sheets 6, 7 are preferably impermeable to liquid and, for example, their interior surfaces facing the main body 1*e* in FIG. 8 may be treated to be water-repellent. In an alternative, a synthetic resin film (e.g., PE film) may be used for the attachment sheets 6, 7. If the attachment sheet is treated to be water-repellent, liquid applied to the interior surface can be easily directed into the clearance between the cleaning head 11 and the cleaning sheet 1 and absorbed by the liquid absorbent sheet 4. This also prevents liquid from remaining on the interior surface of the attachment sheet.

As shown in FIG. 1, the cleaning device 10 comprises the cleaning head 11, a shaft 13 connected to the top face of the cleaning head 11 through a universal joint 12, and a grip 14 secured on the top end of the shaft 13. In the present embodiment, the shaft 13 and the grip 14 constitute a handle 15.

As viewed from above (FIG. 2), the cleaning head 11 has a generally rectangular contour. The cleaning head 11 has a front face 11*a* along one longer side of the rectangle and a rear face 11*b* along the other longer side. Moreover, the cleaning head 11 has a right end face 11*c* along one shorter side and a left end face 11*d* along the other shorter side. The front face 11 and the rear face 11*b* have a length almost equal to the width W of the main body 1*e* of the cleaning sheet 1, while the right end face 11*c* and the left end face 11*d* have a length almost equal to or slightly shorter than the length L3 of the main body 1*e*.

The cleaning head 11 is preferably constructed of a rigid holder 21 injection molded of a synthetic resin, such as acrylonitrile-butadiene-styrene (ABS), polyethylene (PE), polypropylene (PP), polyethylene terephthalate (PET), etc., and a pad 22 secured beneath the holder 21. The pad 22 is preferably formed of a flexible elastic material such as ethylene-vinyl acetate (EVA), urethane, or rubber. Alternatively, the pad 22 may be formed of soft PP or PE. The pad 22 and the holder 21 are preferably bonded and secured together. The bottom face of the pad 22, i.e., the bottom face 23 of the cleaning head 11 is generally flat.

In the top face, the holder 21 has sheet retainers 24 inside four corners of the rectangle, i.e., the corner between the front face 11*a* and the right end face 11*c*, the corner between the front face 11*a* and the left end face 11*d*, the corner between the rear face 11*b* and the right end face 11*c*, and the corner between the rear face 11*b* and the left end face 11*d*. The sheet retainer 24 is preferably constructed by forming an opening 21*a* in the top face of the holder 21 and covering the opening 21*a* with a deformable sheet 25 made of PE, PP, PET, etc. The deformable sheet 25 has a cut 25*a*. FIGS. 3 and 4 show states where the cleaning sheet 1 is retained on the cleaning head 11 such that the attachment sheets 6, 7 are pushed into the cuts 25*a*.

As shown in FIG. 2, a liquid jetting part 30 is mounted on the holder 21. The liquid jetting part 30 is preferably located at the midpoint between the right end face 11*c* and the left end face 11*d* of the holder 21 and in front of the universal joint 12. The liquid jetting part 30 may be constructed of two components: a base 31 and a nozzle head 32. The nozzle head 32 has a front face (squirt surface) 33 where three nozzles 35, 36, 37 have orifices.

As shown in FIG. 1, the shaft 13 is provided with a container holder 41 for holding a container 42 filled with a liquid. In the embodiment of FIG. 1, the container holder 41 and the container 42 constitute a liquid retention part 40. Inside a lower part 41*a* of the container holder 41, there is provided an interrupting mechanism with a valve. The grip 14 is provided with an operating part 43 so that the valve of the interrupting mechanism can be opened by pressing the operating part 43.

Hereinbelow, how to use the cleaning sheet 1 will be described. The cleaning sheet 1 may be used in at least two ways.

FIG. 3 shows a first usage. According to a first usage, the main body 1*e* of the cleaning sheet 1 is laid on the bottom face 23 of the cleaning head 11 with the attachment sheet 6 located on the side of the front face 11*a* of the cleaning head 11 and the attachment sheet 7 located on the side of the rear face 11*b*. The cleaning sheet 1 is fixed on the cleaning head 11 by placing the attachment sheets 6, 7 on the top face of the cleaning head 11 and tucking them into the sheet retainers 24. Here, since the attachment sheet 6 has the indentation 6*a*, the squirt surface 33 of the nozzle head 32 remains exposed externally, as shown in FIG. 6.

As shown in FIG. 5, the main body 1*e* of the cleaning sheet 1 thus attached to the cleaning head 11 can be kept generally flat on the bottom face 23 of the cleaning head 11.

By pressing the operating part 43 with the grip 14 being held by hand, the valve of the interrupting mechanism provided in the lower part 41*a* of the container holder 41 can be opened to permit the space above the liquid within the container 42 to communicate with the atmosphere. As a result, the liquid pressure within the nozzle head 32 is increased through a hollow 13*a* of the shaft 13 and a pipe 44 in accordance with the liquid level within the container 42, and the liquid is squirted forward from the nozzles 35, 36, 37 and applied to the floor surface in front of the cleaning head 11. After the floor surface is wetted with the liquid, the cleaning head 11 is moved forward to wipe the floor with the cleaning sheet 1.

The liquid in the container 42 may be plain water, or may contain a detergent for cleansing a floor surface, a high gloss wax, etc.

As the cleaning head 11 is slid on the floor surface, the liquid, which is foul with fine dust on the floor surface, passes through voids between the constituent fibers of the second exterior sheet 3 and is absorbed and retained by the liquid absorbent sheet 4. This controls the amount of liquid between the first exterior sheet 2 and the floor surface so that the first exterior sheet 2 can retain a moderate amount of water to efficiently wipe off fine dust or dirt. Here, the flaps 61, 61, which are provided on the cleaning surface 1*a* of the cleaning sheet 1 and which are able to move freely at boundaries between the central region 8 and the side regions 9, also facilitate removal of the dirt adhering to the floor surface.

If the liquid drips from the nozzles 35, 36, 37, the dripping liquid can be received by the top face of the base 31. The upper face of the base 31 is inclined to approach the bottom face 23 of the cleaning head 11 as it extends toward the front face 11*a*. Therefore, the liquid dripping on the top face of the base 31 is directed to the front face 11*a* which is covered with the attachment sheet 6 and then to the attachment surface 1*b* of the cleaning sheet 1. Since the liquid applied to the attachment surface 1*b* can pass through the backing sheet 5 and be absorbed by the liquid absorbent sheet 4, the bottom face 23 of the cleaning head 11 is prevented from being soaked with the liquid.

This also prevents the liquid from dripping on the floor surface when the cleaning sheet 1 is removed from the cleaning device 10. In addition, since the detergent is also prevented from remaining between the bottom face 23 of the cleaning head 11 and the cleaning sheet 1, slippage due to the detergent can be prevented from occurring between the bottom face 23 and the cleaning sheet 1.

FIG. 4 shows a second usage of the cleaning sheet 1. According to a second usage, the main body 1*e* of the cleaning sheet 1 is laid on the bottom face 23 of the cleaning head 11 and the attachment sheet 7 is tucked into the sheet retainers 24 while covering the front face 11*a* of the cleaning head 11. The attachment sheet 7 is rectangular and dimensioned to be able to cover the squirt surface 33 of the nozzle head 32, as shown in FIG. 4. On the other hand, the attachment sheet 6 formed with the indentation 6*a* is tucked into the sheet retainers 24 while covering the rear face 11*b* of the cleaning head 11.

According to the second usage, when the liquid is squirted from the nozzles 35, 36, 37 of the nozzle head 32 by pressing the operating part 43 of the grip 14, the liquid is received by the attachment sheet 7, conducted to the bottom face 23 of the cleaning head 11 and then absorbed by the liquid absorbent sheet 4 of the cleaning sheet 1 through the backing sheet 5.

When the cleaning head 11 is pressed against the floor surface, therefore, the liquid absorbed in the liquid absorbent sheet 4 is applied to the floor surface through the second exterior sheet 3 in the side regions 9, which results in that the first exterior sheet 2, which is inferior in liquid-permeability to the second exterior sheet 3, is moderately wetted to remove the dirt from the floor surface.

In the second usage, the liquid, which is not directly applied to the floor surface but to the liquid absorbent sheet 4, can be gradually applied to the floor surface in accordance with a pressure between the cleaning head 11 and the floor surface, i.e., a force exerted to push the cleaning head 11 against the floor surface. Accordingly, even if the floor surface is a wooden floor on which a finishing compound is applied, the amount of liquid between the cleaning sheet 1 and the floor surface can be easily controlled to prevent deterioration of the finishing compound.

Although the present invention has been illustrated and described with respect to exemplary embodiments thereof, it should be understood by those skilled in the art that the foregoing and various other changes, omission and additions may be made therein and thereto, without departing from the spirit and scope of the present invention. For example, the main body 1*e* of the cleaning sheet 1 where the liquid absorbent sheet 4 is present may be of an oval or elliptical shape. The attachment sheets 6, 7 may be integral with one of the sheets constituting the main body 1*e*.

Therefore, the present invention should not be understood as limited to the specific embodiments set out above but should be understood to include all possible embodiments which can be embodied within a scope encompassed and equivalent thereof with respect to the features set out in the appended claims.

What is claimed is:

1. A cleaning sheet having an attachment surface to be applied to a bottom face of a cleaning head of a cleaning device and a cleaning surface to be applied to an object to be cleaned, the cleaning sheet comprising:

a first exterior sheet;

a second exterior sheet that is liquid permeable with a fiber density lower than a fiber density of the first exterior sheet, the second exterior sheet being larger in size than the first exterior sheet;

a liquid absorbent sheet capable of absorbing and retaining liquid, the liquid absorbent sheet being provided on a side of the second exterior sheet facing the attachment surface, and the first exterior sheet being exposed on the cleaning surface; and a backing sheet that is liquid permeable and provided on a side of the liquid absorbent sheet facing the attachment surface, the backing sheet being exposed on the attachment surface, and the first exterior sheet being exposed on the cleaning surface, wherein the first exterior sheet defines a first region of the cleaning surface; and the second exterior sheet extends from the first region to a second region of the cleaning surface outside the first region, the first exterior sheet and the second exterior sheet being fixed to each other at fixing regions located in the first region such that a portion of the first exterior sheet located between an edge of the second region and at least one of the fixing regions is allowed to move freely while being fixed at the at least one fixing region.

2. The cleaning sheet of claim 1, wherein the liquid absorbent sheet extends over a rectangular region inside the cleaning surface, a length of the rectangular region in the transverse direction being longer than a length in the longitudinal direction, and the second region extending from two opposite ends of the first region in the transverse direction.

3. The cleaning sheet of claim 2, further comprising attachment sheets for mounting the cleaning sheet to the cleaning head, one of the attachment sheets having an indentation.

4. The cleaning sheet of claim 3, wherein the attachment sheets are exposed on the attachment surface, the exposed surface of the attachment sheets being water-repellent.

5. The cleaning sheet of claim 3, wherein only one of the attachment sheets has an indentation along an outer edge of the attachment sheets.

* * * * *